US006052833A

United States Patent [19]

Norman

[11] Patent Number: 6,052,833

[45] Date of Patent: Apr. 25, 2000

[54] HELMET AIR STREAM DEFLECTOR

[76] Inventor: Lester D. Norman, 3649 Hwy 40 W, Columbia Falls, Mont. 59912

[21] Appl. No.: 08/957,728

[22] Filed: Oct. 24, 1997

[51] Int. Cl.[7] ..... A42B 3/00

[52] U.S. Cl. ..... 2/422; 2/410

[58] Field of Search ..... 2/410, 411, 422, 2/424, 425, 468, DIG. 5, 421, 459; D29/102, 103, 106, 107

[56] References Cited

U.S. PATENT DOCUMENTS

| | | | |
|---|---|---|---|
| 3,280,402 | 10/1966 | Scheibchen | 2/410 |
| 3,286,275 | 11/1966 | Marchello | 2/410 |
| 3,548,410 | 12/1970 | Parker | 2/424 |
| 4,586,197 | 5/1986 | Hubbard | 2/410 |
| 4,887,319 | 12/1989 | Daniels | 2/410 |
| 5,062,163 | 11/1991 | Avey | 2/424 |
| 5,095,550 | 3/1992 | Perlinger | 2/422 |
| 5,097,538 | 3/1992 | Feuling | 2/410 |
| 5,361,419 | 11/1994 | Bernstein | 2/425 |
| 5,493,736 | 2/1996 | Allison | 2/416 |
| 5,517,691 | 5/1996 | Blake | 2/5 |
| 5,575,018 | 11/1996 | Rothrock | 2/424 |

FOREIGN PATENT DOCUMENTS

| | | | |
|---|---|---|---|
| 2700670 | 7/1994 | France | 2/424 |
| 3305735 | 8/1984 | Germany | 2/410 |
| 24083 | 5/1988 | Japan | 2/411 |
| 671864 | 10/1989 | Switzerland | 2/410 |
| 3457 | 6/1987 | WIPO | 2/424 |

*Primary Examiner*—Michael A. Neas
*Attorney, Agent, or Firm*—Dowrey & Associates

[57] ABSTRACT

An air stream deflector for a convexly curved helmet including a continuous or segmented, semicircular, elongated lip projecting from the rear and side surfaces of the helmet closely adjacent the lower edge thereof. The lip may be integral with the helmet or include a curved attachment surface adapted to be connected to the helmet surface. The lip includes an outwardly and upwardly curved deflector surface with a rolled outer edge for channeling moisture and debris forwardly.

21 Claims, 3 Drawing Sheets

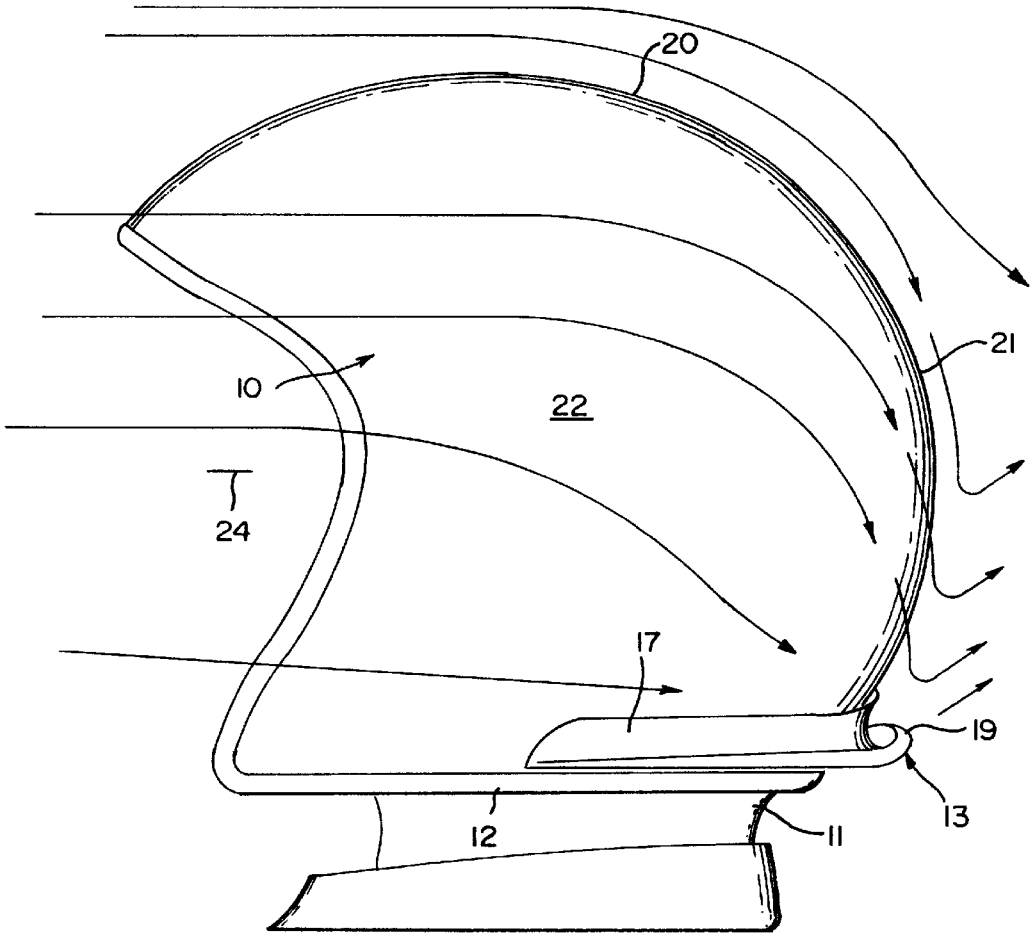
FIG. 1
FIG. 3
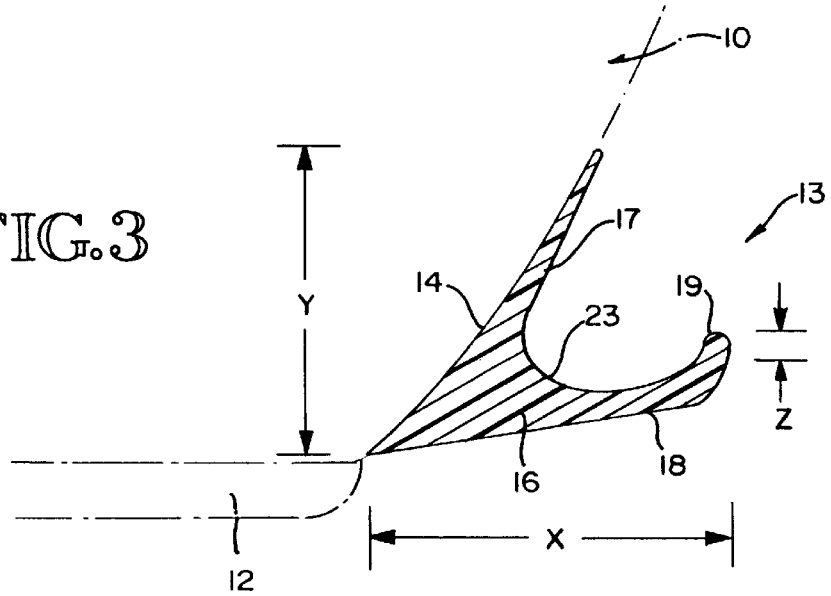

HELMET AIR STREAM DEFLECTOR

BACKGROUND OF THE INVENTION

1. Field of the Invention

The present invention relates to safety helmets such as those worn for example by motorcyclists, police officers, or race car drivers which are subject to high velocity air streams caused either by high speed travel, high wind velocities or a combination of both. More particularly, the invention relates to an air stream deflector unit made either integral with the helmet body or provided as a helmet after market attachment.

2. Description of the Prior Art

The prior art contains various examples of devices for attachment to hard hats and other protective head gear to shield the wearer's neck and face against the elements. Devices such as those shown in the U.S. patents to Daniels U.S. Pat. No. 4,887,319; Avey U.S. Pat. No. 5,062,163 and Blake U.S. Pat. No. 5,517,691 seek to solve the problem by the use of wraparound enclosures connected to the helmet and surrounding the wearer's neck and/or face. This approach to protecting the wearer has also been applied to motorcycle helmets as disclosed in U.S. Pat. No. 5,095,550 to Perlinger. Although the disclosure in this patent recognizes the problem of air flow about the helmet, the proposed solution is a closure for the head opening in the helmet which surrounds the wearer's neck. No attempt is made to deflect the air stream flow. In fact, very little attention has been given to diverting or deflecting the air stream about a cyclist's or other wearer's helmet which is subject to high velocity air flow.

Although U.S. Pat. No. 4,586,197 to Hubbard recognizes some of the problems caused by high velocity airflow about the cyclist's helmet, the object in this patent is to aerodynamically balance the front and rear air pressure against the helmet at high speeds. For this purpose a visor is attached to the backside of the helmet and acts as a fixed air scoop for somehow directing air pressure against the back of the helmet to balance that pressure acting on the front face shield. In the Hubbard device, the air stream is apparently redirected with increased force to the backside of the helmet and the wearer's neck which would seem to augment the problems of airflow addressed by the present invention.

U.S. Pat. Nos. 3,280,402 and 3,286,275 to G. Scheibchen and J. L. Marchello respectively are cited as being of interest for their showing of conventional hat brims used for protective headgear. These structures either strengthen or rigidify the rear edge of protective gear, such as seen in Scheibchen, or are used for the purpose of style as seen in the conventional hat design of Marchello. Neither of these devices relate to headgear or protective helmets subject to high velocity air stream and the problems caused thereby.

The patent to Allison U.S. Pat. No. 5,493,736 is cited as an example of a projection about the bottom edge of a protective helmet, in this case one worn by football player. The device is in the form of a collar about the base of the helmet which cooperates with shoulder pads to prevent neck injuries.

SUMMARY OF THE INVENTION

The present invention provides an airstream deflector for protective headgear such as safety helmets used by motorcyclists, policemen and race car drivers as an example. In the broadest sense, the invention is not limited to any particular helmet or helmet use but is suitable for any helmet type protective headgear that is subjected to a high velocity airstream. The airstream follows the natural contours of the helmet and has a detrimental effect on the neck and shoulders of the helmet wearer. The invention is particularly adapted to the type of helmet having a rounded or spherical surface with a bottom rim partially or wholly surrounding and in close proximity to the wearer's neck. This type of helmet typically not only curves downwardly but inwardly toward the bottom edge or rim. A high velocity airstream such as experienced during road travel or when facing a wind or jet stream results in high velocity air flow down over the back and sides of the helmet creating a turbulence directly in back of the helmet. This airstream of course may direct cold air, rain, bugs, road debris, sand and dust directly on the wearer's neck and shoulders. According to the present invention a semicircular lip device is attached closely adjacent the bottom edge of the helmet and extends from the rear of the helmet forwardly in both directions in an approximate 180° arc about the helmet body. The lip device is so located and configured as to deflect air currents passing over and around the helmet body in an upward direction away from the helmet and the wearer's neck. The lip structure provides this function without increasing the turbulence behind the helmet body since the jetstream from either the motorcycle windshield or the top of the helmet picks up and dissipates the upwardly turned air currents. The deflector is provided with an upwardly directed dished or curved surface having a curled outer edge or rim for the purpose of collecting and channeling any moisture or other debris contained in the airstream and draining from the helmet surface forwardly and away from the wearer's neck and shoulders.

The lip structure may be molded integral with the helmet shell or may be provided as an attachment to existing helmets of the type under consideration. Although the lip structure may be made of any material suitable for performing the intended function, if fabricated as a separate attachment, a semi rigid, flexible or deformable plastic material is preferred. The attachment will have a mating curved surface along its length to conform to the curvature of the particular helmet and will extend in a semi circular configuration about the back and side areas of the helmet closely adjacent its lower or bottom edge. Alternatively the lip structure may be segmented with any suitable interconnecting means provided to interface or connect the segments. The lip attachment may be attached to the helmet by such means as a silicone adhesive or any other compatible adhesive. In the alternative, such devices as double stick surface adhesive strips or velcro strips may be used to securely hold the attachment to the helmet surface.

BRIEF DESCRIPTION OF THE DRAWINGS

Further advantages of the helmet air stream deflector of the present invention will be apparent from the following description with reference to the accompanying drawings in which:

FIG. 1 is a side elevational view of a helmet with the lip attachment in place and depicting the typical air stream pattern over and about the helmet surface;

FIG. 3 is a cross sectional view taken along lines 3—3 of FIG. 3.

DETAILED DESCRIPTION OF THE PREFERRED EMBODIMENT

FIG. 1 illustrates a standard open faced helmet 10 used most commonly by motorcyclists for road travel. Although the present embodiment will be described with reference to a motorcyclist's helmet, it will be understood that the invention is not limited to use with this particular helmet type. The present invention has utility with any protective headgear subject to high velocity air stream flow and which is shaped in a manner which results in the flow of air over and around the helmet and downwardly onto the wearer's neck and shoulders. As shown in FIG. 1, the helmet 10 comprises a shell with a convex, rounded or spherical shaped outer surface which is curved downwardly and inwardly toward the neck 11 of the wearer and usually terminates in a padded rim or cushioned lower edge 12 which extends around the back and sides of the wearer's neck. Helmets of this type are, of course, usually constructed of high impact plastic with internal support webbing of some type (not shown) with a chin strap or the like for holding the helmet securely on the wearer's head. The lip attachment of the present invention, indicated generally at 13 in FIG. 1, is illustrated in its operative position around the back and sides of the helmet 10 closely adjacent the bottom rim 12 of the helmet.

Figure 2A:
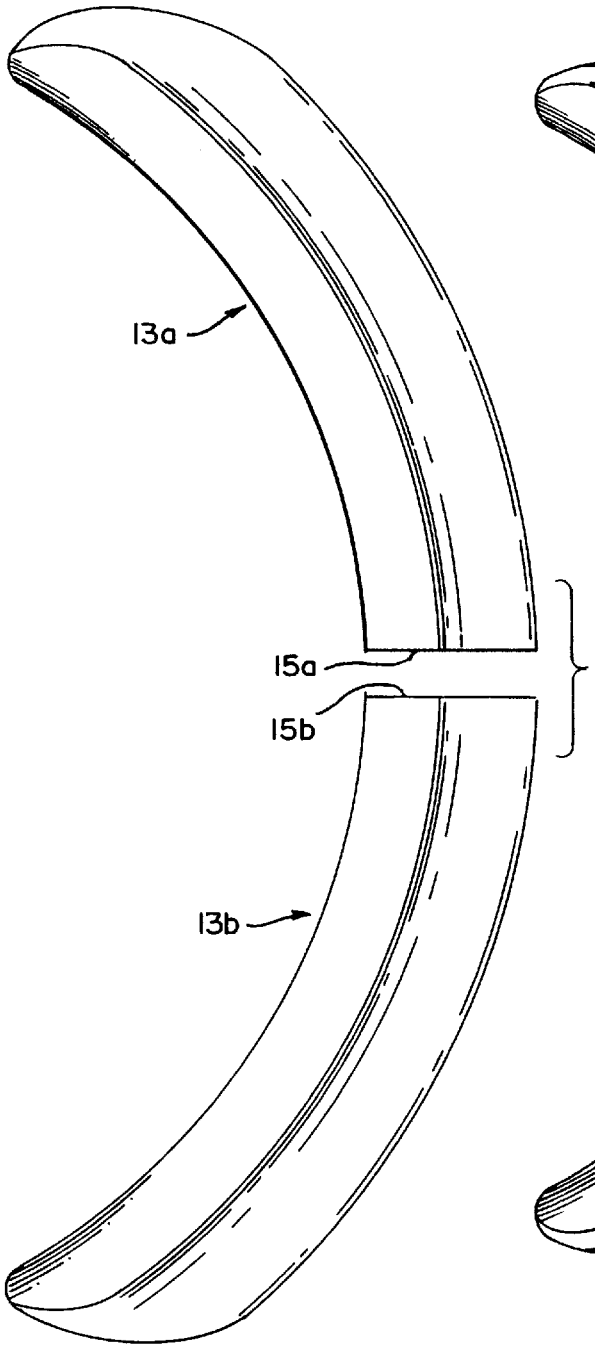
FIG. 2A is a top plan view showing a segmented lip attachment.
Figure 2:
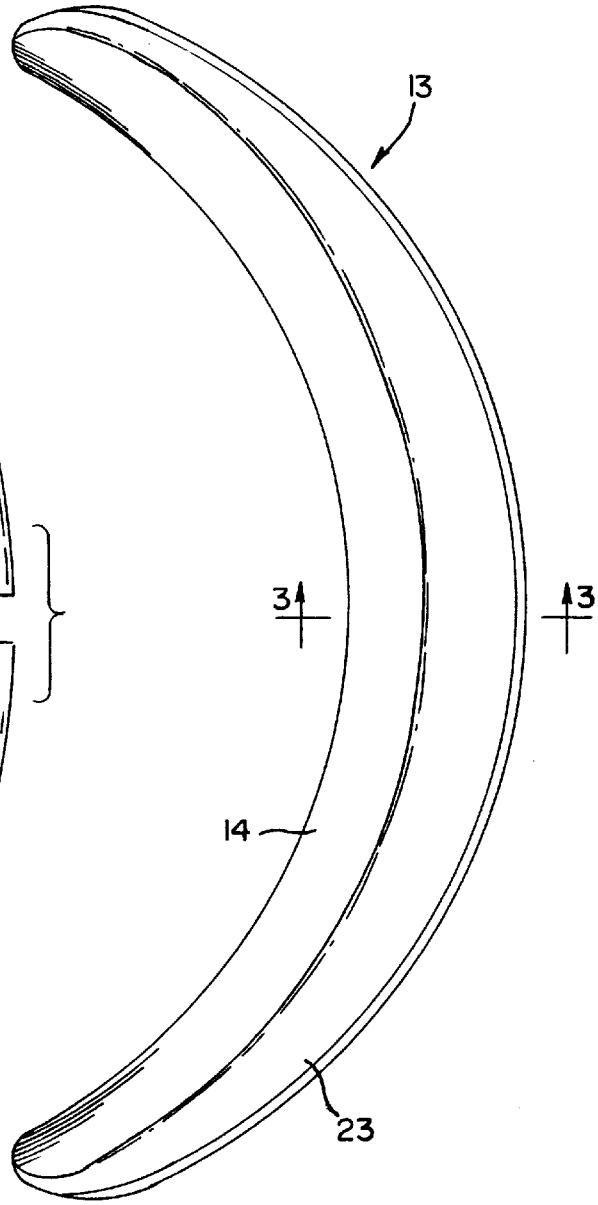
FIG. 2 is a top plan view of the lip attachment.
Figure 4:
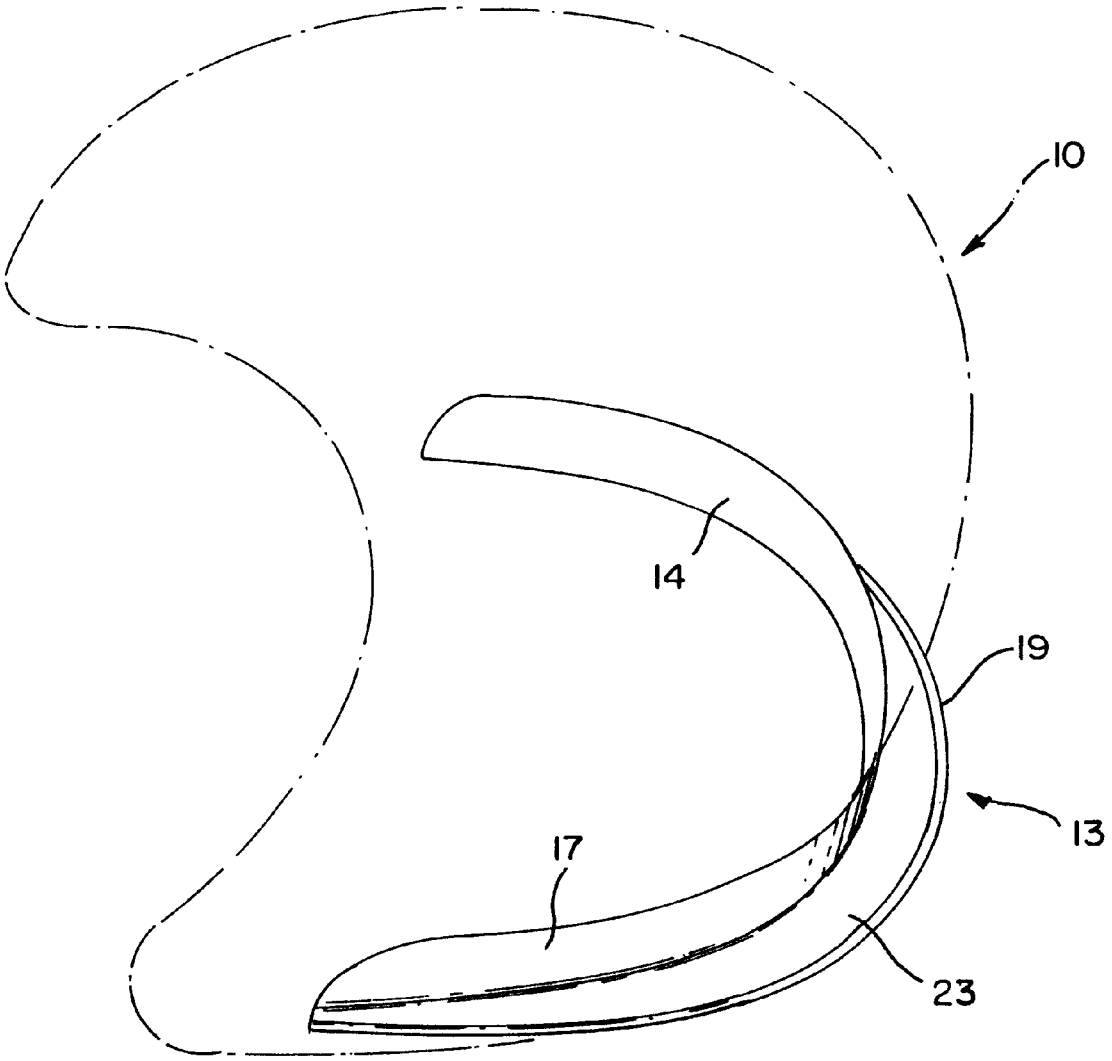
FIG. 4 is a perspective view of the lip attachment with the position of the helmet shown in dotted lines.

As shown in FIGS. 2 and 4, the lip attachment structure is semi circular in plan and extends approximately 180° about the back and sides of the helmet. It will be understood however, that the exact length of the curved attachment may be varied and the curvature will be determined by the shape of the particular helmet for which the attachment is intended. It is also preferable to construct the attachment from a flexible or deformable plastic material so that different helmet sizes may be accommodated with a single attachment. The lip structure includes a curved attachment surface 14 which is angled or curved to approximately match the contours of the helmet surface to ensure a full face engagement. Although mechanical devices such as velcro strips or the like may be used to attach the lip, a silicone or other adhesive or double faced adhesive strip is preferably used for this purpose.

FIG. 2A illustrates the alternative embodiment previously discussed wherein the lip attachment is segmented, shown as but not limited to segments 13*a* and 13*b*, which have mating end surfaces 15*a* and 15*b* respectively which may be of any desired configuration, well within the skill of an artisan.

As seen in FIG. 3, the lip body 16 provides the angled or contoured rear wall 17 which attaches to the helmet surface and an outwardly and upwardly projecting ledge 18 which is provided with a curled edge 19 for a purpose to be described. The wall 17 and ledge 18 form the curved channel 23 which extends the length of the lip attachment. As will be seen in FIG. 3, the surface of the channel 21 curves outwardly and upwardly toward the curled edge 19 to provide the air stream deflector surface. In the preferred embodiment, the lip attachment 13 extends outwardly a distance x which may be approximately 1½ inches in the typical helmet. The vertical distance y of the lip attachment may be approximately 1¼ inches with the width z of the curled edge 19 being in the order of approximately ¼ inches. Although these dimensions have been found to provide satisfactory results, it will be understood that the present invention, in its broadest sense, is not limited to these dimensions which may be varied within the scope and spirit of the invention.

FIG. 1 depicts the air flow about the typical motorcyclist's helmet during road travel. As illustrated, the air stream flows over the top surface 20 of the helmet and curves downwardly along the rear and side surfaces 21 and 22 respectively so as to direct the air flow onto the neck and shoulders of the wearer. As may well be understood, in inclement or cold weather, rain, snow or any other airborne debris is deposited by the turbulent air on the wearer's neck. With the deflector lip attachment of the present invention in place as seen in FIG. 1, the air flow across the top surface 20 and around the side surface 22 of the helmet is deflected upwardly and away form the user's neck and shoulders. The shape of the channel 23 not only serves to deflect the air stream because of its upwardly and outwardly curved surface but also serves to channel off any debris or moisture droplets carried or deposited by the air stream or draining off the surface of the back and sides of the helmet. For this purpose the curled rim 19 of the lip serves to trap and retain moisture and debris which drains forwardly toward the face area 24 of the helmet and is swept away by the side air stream avoiding any contact with the user's neck and shoulders.

With the open face motorcyclist's helmet illustrated and with a lip attachment of the proportions described, air flow around the user's neck when traveling at road speeds has been found to be minimal. Additionally, no appreciable increase in air turbulence is experienced by a back seat passenger.

It is to be understood that the foregoing description and accompanying drawings have been given by way of illustration and example. It is also to be understood that changes in form of the several parts, substitution of equivalent elements and arrangement of parts which will be readily apparent to one skilled in the art, are contemplated as within the scope of the present invention, which is limited only by the claims which follow.

What is claimed is:

1. In combination with a protective helmet having convexly curved surfaces and a lower edge extending about the rear and side areas of the wearer's neck below the ears in the side areas and above the shoulders, an air stream deflector for deflecting rearward and downward high velocity air stream flow comprising;

an elongated lip structure on the surface of said helmet located closely adjacent said lower edge and extending arcuately thereabout to include the rear and side areas of the wearer's neck, said lip structure including a deflector surface curved upwardly and outwardly from the helmet surface for deflecting said high velocity air stream flow upwardly and outwardly from the helmet surface, whereby said lip structure deflects high velocity air stream flow from across the top and around the side surfaces of the helmet upwardly and away from the wearer's neck and shoulders, said curved deflector surface serving to channel off debris and moisture carried by said air stream.

2. The combination of claim 1 further including;

a curled outer rim on said lip structure for collecting and retaining moisture and debris to be channeled in a forward direction by said deflector surface.

3. The combination of claim 2 wherein said lip structure is arcuate and extends approximately 180° about the rear and sides of the helmet.

4. The combination of claim 3 wherein said lip structure includes an attachment surface contoured to substantially conform to the surface of said helmet, and means to attach said lip structure to said helmet with said attachment surface in full surface contact therewith.

5. The combination of claim 4 wherein said lip structure comprises a continuous semi rigid flexible member.

6. The combination of claim 4 wherein said lip structure is comprised of at least two segments in end abutting relationship.

7. The combination of claim 4 wherein said lip structure extends outwardly from the surface of said helmet a distance of approximately 1½ inches.

8. The combination of claim 6 further including means for attaching the abutting ends of said segments.

9. A high velocity air stream deflector for use with protective headgear having rigid convexly curved top and side surfaces covering the wearer's head and terminating in a bottom edge extending about the back and side areas of the wearer's neck below the ears in the side areas and above the shoulder comprising;

an elongated lip structure adapted to extend arcuately about the rear and side surfaces of said headgear closely adjacent the bottom edge thereof to include rear and side areas of the wearer's neck, said lip structure including;

an attachment surface conforming to the approximate curvature of said headgear and adapted for surface engagement therewith, a curved deflector surface directed upwardly and outwardly away from said attachment surface for deflecting high velocity air stream flow away from said headgear, and means for securing said lip to the surface of the headgear, whereby said lip structure deflects high velocity air stream flow from across the top and around the side surfaces of the protective headgear upwardly and away from the wearer's neck and shoulders, said curved deflector surface serving to channel off debris and moisture carried by said air stream.

10. The air stream deflector of claim 9 including;

a curled outer rim on said lip structure for collecting and retaining moisture and debris to be channeled in a forward direction by said deflector surface.

11. The air stream deflector of claim 10 wherein said lip structure is arcuate and extends approximately 180° about the rear and side surfaces of said headgear.

12. The air stream deflector of claim 11 wherein said lip structure comprises a continuous semi rigid flexible member.

13. The air stream deflector of claim 12 wherein said lip structure is composed of at least two segments in and abutting relationship.

14. The air stream deflector of claim 12 wherein said lip structure extends outwardly from the surface of the headgear a distance of approximately 1½ inches.

15. The combination according to claim 13 further including means for attaching the abutting ends of said segments.

16. A protective headgear comprising in combination;

a rigid convexly curved shell for substantially surrounding the wearer's head, said shell including a front area, a top surface and downwardly curved side and rear surfaces terminating in a lower edge located about the back and side areas of the wearer's neck below the ears in the side areas and above the shoulders, and a high velocity air stream deflector located on said side and rear surfaces for deflecting downward air stream flow from said surfaces upwardly and outwardly away from the shell, said air stream deflector including a lip structure extending arcuately about the back and sides of said shell closely adjacent said lower edge to include the rear and side areas of the wearer's neck, a deflector surface on said lip structure, said deflector surface extending outwardly and upwardly away from the shell surface to deflect the downward air stream flow therefrom and away from the wearer's neck and shoulders, and a curled outer rim on said lip structure for collecting and retaining moisture and debris deposited by said air stream flow to be channeled from said shell surfaces by said deflector surface toward the front area of the shell.

17. The combination of claim 16 wherein said lip structure extends approximately 180° about said shell.

18. A method for protecting the neck of a wearer of a helmet having convexly curved top, side and rear surfaces with a bottom edge extending about the wearer's neck below the ears and above the shoulders, said helmet being subject to high velocity air stream flow passing over the surfaces thereof, comprising the steps of;

deflecting the air stream flow in an upward and outward direction away from the helmet surface with a lip structure extending outwardly therefrom at a location closely adjacent the bottom edge of the helmet to include the rear and side areas of the wearer's neck, and channeling moisture and debris carried by said air stream from the helmet surface forwardly and away from the wearer's neck.

19. The method of claim 18 including the step of;

channeling said moisture and debris in an arcuate path approximately 180° about the rear and side surfaces of said helmet.

20. The method of claim 19 wherein said lip structure includes an outwardly and upwardly curved deflector and including the step of;

retaining said moisture and debris with a curled outer rim on said lip structure for channeling forwardly thereby.

21. The method of claim 20 wherein said lip structure extends outwardly from the surface of said helmet a distance of approximately 1½ inches.

* * * * *

UNITED STATES PATENT AND TRADEMARK OFFICE

CERTIFICATE OF CORRECTION

PATENT NO : 6,052,833

DATED : Apr. 25, 2000

INVENTOR(S) : Lester D. Norman

It is certified that error appears in the above-identified patent and that said Letters Patent are hereby corrected as shown below:

Col. 5, line 43, change "and" to read --end--

Signed and Sealed this

Eighth Day of May, 2001

*Attest:*

Nicholas P. Godici

NICHOLAS P. GODICI

*Attesting Officer*

*Acting Director of the United States Patent and Trademark Office*